US006977559B2

(12) United States Patent
Shimizu et al.

(10) Patent No.: US 6,977,559 B2
(45) Date of Patent: Dec. 20, 2005

(54) NONRECIPROCAL CIRCUIT ELEMENT WITH NOTCH PART IN YOKE

(75) Inventors: Yuichi Shimizu, Fukushima-ken (JP); Takamitsu Shibayama, Fukushima-ken (JP); Eiichi Komai, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 33 days.

(21) Appl. No.: 10/842,896

(22) Filed: May 10, 2004

(65) Prior Publication Data

US 2004/0227579 A1 Nov. 18, 2004

(30) Foreign Application Priority Data

May 14, 2003 (JP) ..... 2003-135300

(51) Int. Cl.[7] ..... H01P 1/383
(52) U.S. Cl. ..... 333/1.1; 333/24.2
(58) Field of Search ..... 333/1.1, 24.2

(56) References Cited

U.S. PATENT DOCUMENTS 5,898,346 A 4/1999 Kamei et al. ..... 333/1.1
6,597,257 B1 7/2003 Kawanami et al. ..... 333/24.2

*Primary Examiner*—Stephen E. Jones
(74) *Attorney, Agent, or Firm*—Brinks Hofer Gilson & Lione

(57) ABSTRACT

Provided is a nonreciprocal circuit element which has increased lengths of central conductors to be compatible with miniaturization while exhibiting superior performance. In the nonreciprocal circuit element, a first yoke has a rectangular upper plate, a pair of side plates bent downward from sides of the upper plate facing each other, and notch parts formed at the central portion of the pair of side plates. Ends of a magnet are placed within the notch parts. Thus, the magnet can be enlarged and a ferrite member provided corresponding thereto can also be enlarged. Accordingly, the lengths of conductors of central conductors mounted on the ferrite member are increased, thereby achieving high performance while not adversely affecting miniaturization.

9 Claims, 8 Drawing Sheets

NONRECIPROCAL CIRCUIT ELEMENT WITH NOTCH PART IN YOKE

This application claims the benefit of priority to Japanese Patent Application No. 2003-135300, herein incorporated by reference.

BACKGROUND OF THE INVENTION

1. Field of the Invention

The present invention relates to a nonreciprocal circuit element such as an isolator or a circulator used for an antenna duplexer or the like.

2. Description of the Related Art

A conventional nonreciprocal circuit element will now be described with reference to FIGS. 13 to 15, in which FIG. 13 is an exploded perspective view of a conventional nonreciprocal circuit element, FIG. 14 is a plan view illustrating essential parts of the conventional nonreciprocal circuit element, and FIG. 15 is a developed view of a central conductor of the conventional nonreciprocal circuit element.

Referring to FIGS. 13 through 15, the conventional nonreciprocal circuit element includes a first box-shaped yoke 51, a disk-shaped magnet 52 disposed in the first yoke 51, and a flat ferrite member 53 disposed under the magnet 52. The conventional nonreciprocal circuit element further includes three central conductors 54, 55 and 56 formed of metal plates partly intersecting one another and mounted on the ferrite member 53 by being spaced apart from one another by an angle of 120 degrees, a box-shaped resin case 57 accommodating the ferrite member 53, and a second U-shaped yoke 58 disposed under the resin case 57.

The first box-shaped yoke 51 has a rectangular upper plate 51*a*, and four side plates 51*b* bent downward from four sides of the upper plate 51*a*. A magnet 52 is arranged within the first yoke 51, and its top surface is adhered to the inner surface of the upper plate 51*a* using an adhesive or the like.

The ferrite member 53 has a rectangular configuration in which two long sides 53*a* face each other and two short sides 53*b* face each other. The top surface of the ferrite member 53 is disposed to face the magnet 52 within the effective range of the bottom surface of the magnet 52.

As shown in FIG. 15, first, second and third central conductors 54, 55 and 56 are formed by notching metal plates and extend outwardly from a square ground portion 70 which is disposed in the center thereof.

Each of the first, second and third central conductors 54, 55 and 56 has two-divided conductors 54*a*, 55*a* and 56*a* each having a slit formed in a vertical direction, and first, second and third port portions 54*b*, 55*b* and 56*b* provided at ends of the conductors 54*a*, 55*a* and 56*a*, respectively.

The first, second and third central conductors 54, 55 and 56 are configured such that the ground portion 70 is disposed under the ferrite member 53. In such a state, the conductors 54*a*, 55*a* and 56*a* are bent along the side and top surfaces of the ferrite member 53.

The first, second and third central conductors 54, 55 and 56 are disposed on the top surface of the ferrite member 53 in a vertical direction in a state in which they are individually insulated from one another by insulators, although not shown.

When the first, second and third central conductors 54, 55 and 56 are mounted on the ferrite member 53, the first and second central conductors 54 and 55 are placed at the short sides 53*b* so as to traverse the longer surface of the ferrite member 53 while the third central conductor 56 is placed at the long side 53*a* so as to traverse the shorter surface of the ferrite member 53 in a state in which it is parallel to the short sides 53*b*.

The resin case 57 has a bottom wall 57*b* having a rectangular hole 57*a* at its central portion. The bottom wall 57*b* has concave portions 57*c* formed along three sides of the hole 57*a*. The ferrite member 53 having the first, second and third central conductors 54, 55 and 56 mounted thereon is disposed within the hole 57*a*, so that the ground portion 70 corresponding to one end of each of the first, second and the third central conductors 54, 55 and 56 is connected to the second yoke 58.

Chip-type capacitors 62, 63 and 64 and a chip-type resistor 65 are arranged within the concave portions 57 around the hole 57*a*, and lower electrodes of the capacitors 62, 63 and 64 and an electrode 65*a* at one end of the resistor 65 are connected to the second yoke 58, respectively.

The respective port portions 54*c* and 55*c* of the first and second central conductors 54 and 55 are connected to the upper electrodes of the capacitors 62 and 63 by soldering, while the port portion 56*c* of the third central conductor 56 is connected to the upper electrode of the capacitor 64 and to the top surface of the electrode 65*b* at the other end of the resistor 65 by soldering.

In other words, the capacitor 62 is disposed in one of long sides 53*a* of the ferrite member 53, and the capacitor 63 is disposed at the short side 53*b* perpendicular to the long side 53*a*. Also, the capacitor 64 and the resistor 65 are formed at the other long side 53*a* so as to surround the hole 57*a*.

In a state in which the magnet 52, the ferrite member 53 and the resin case 57 are interposed between the first and second yokes 51 and 58, the first and second yokes 51 and 58 are connected with each other to form a closed magnetic circuit composed of the first and second yokes 51 and 58, thereby completing the nonreciprocal circuit element, as disclosed in U.S. Pat. No. 6,597,257.

However, since the magnet 52 of the conventional nonreciprocal circuit element is accommodated in the box-shaped first yoke 51, it is necessary to reduce the size of the magnet 52 and the ferrite member 53 provided corresponding thereto.

As the nonreciprocal circuit element becomes smaller sized, the magnet 53 and the ferrite member 53 are further miniaturized accordingly. Consequently, the lengths of the two-divided conductors 54*a*, 55*a* and 56*a* of the first, second and third central conductors 54, 55 and 56 mounted on the ferrite member 53 are decreased, resulting in deteriorating the performance of the nonreciprocal circuit element.

Also, since the capacitors 62, 63 and 64 and the resistor 65 are arranged in the vicinity of the hole 57*a* including the ferrite member 53, the ferrite member 53 reduces in size. Further, since the lengths of the conductors 54*a*, 55*a* and 56*a* of the first, second and third central conductors 54, 55 and 56 reduce, the performance of the nonreciprocal circuit element may deteriorate.

SUMMARY OF THE INVENTION

Accordingly, an object of the present invention is to provide a nonreciprocal circuit element which has increased lengths of central conductors to be compatible with miniaturization while exhibiting superior performance.

To accomplish the above object, according to a first solving means of the present invention, there is provided a nonreciprocal circuit element a flat ferrite member, first, second and third central conductors disposed on the ferrite member such that they are disposed on surfaces different in a vertical direction with a dielectric element interposed therebetween, and parts thereof intersecting one another in the vertical direction, a magnet disposed on the central conductors, a first yoke disposed so as to cover the top surface of the magnet, and a second yoke forming a closed magnetic circuit in combination with the first yoke, the second yoke being disposed below the ferrite member, the first yoke has a rectangular upper plate, a pair of side plates bent downward from at least sides of the upper plate facing each other, and notch parts formed in the central portion of the pair of side plates, and the respective ends of the magnet are placed within the notch parts.

According to second solving means of the present invention, the ends of the ferrite member are disposed in proximity to extension lines of the side plates.

Also, according to third solving means of the present invention, the magnet may have a quadrangular shape having long sides and short sides, and the ends of the short sides of the magnet may be placed within the notch parts.

Further, according to forth solving means of the present invention, chamfers may be formed at corners of the magnet.

Preferably, according to fifth solving means of the present invention, the ferrite member has a quadrangular shape having long sides and short sides, and in a state in which the long sides of the magnet are joined to the long sides of the ferrite member and the short sides of the magnet are joined to the short sides of the ferrite member, respectively, the top surface of the ferrite member is disposed within the dimension of the bottom surface of the magnet, and the short sides of the ferrite member are disposed in proximity of the extension lines of the side plates.

In sixth solving means of the present invention, chamfers may be formed at corners of the ferrite member.

As seventh solving means of the present invention, the bottom surface of the magnet placed within the notch parts does not contact with the side plates and the second yoke.

Further, as eighth solving means of the present invention, a resin case may be provided in the second yoke, and the resin case has a first receiving portion in which the ferrite member is accommodated, and a plurality of second receiving portions in which a plurality of capacitors connected to the central conductors are accommodated.

Preferably, as ninth solving means of the present invention, the first receiving portion is arranged at the central portion of the resin case and the second receiving portions are arranged at both sides of the first receiving portion along the long sides of the magnet and the ferrite member.

BRIEF DESCRIPTION OF THE DRAWINGS

The above aspect and advantages of the present invention will become more apparent by describing in detail preferred embodiments thereof with reference to the attached drawings in which.

DESCRIPTION OF THE PREFERRED EMBODIMENT

Figure 1:
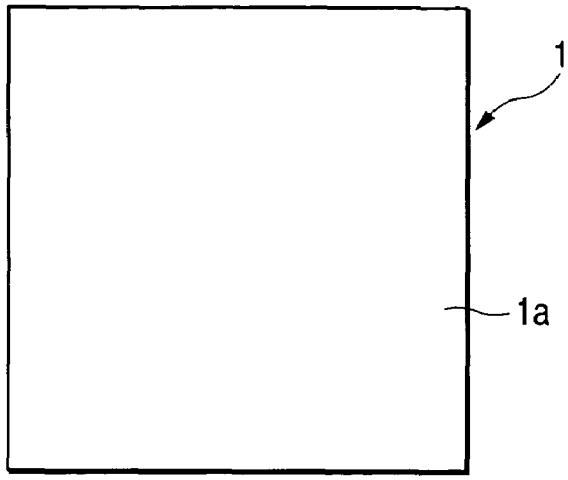
FIG. 1 is a plan view of a nonreciprocal circuit element according to the first embodiment of the present invention.
Figure 2:
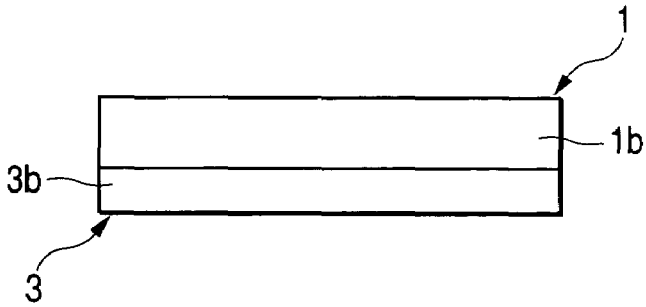
FIG. 2 is a front view of the nonreciprocal circuit element according to the first embodiment.
Figure 3:
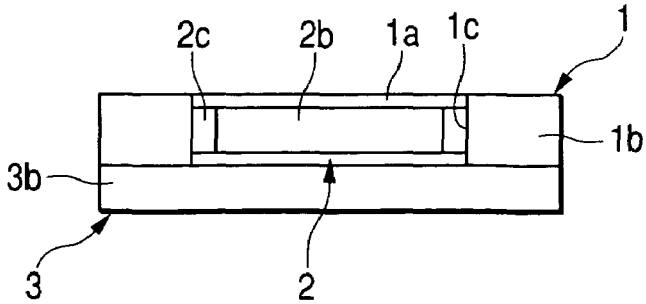
FIG. 3 is a side view of the nonreciprocal circuit element according to the first embodiment.

A nonreciprocal circuit element according to the present invention will be described with reference to the accompanying drawings, in which FIG. 1 is a plan view of a nonreciprocal circuit element according to the first embodiment of the present invention, FIG. 2 is a front view of the nonreciprocal circuit element according to the first embodiment, and FIG. 3 is a side view of the nonreciprocal circuit element according to the first embodiment.

Figure 4:
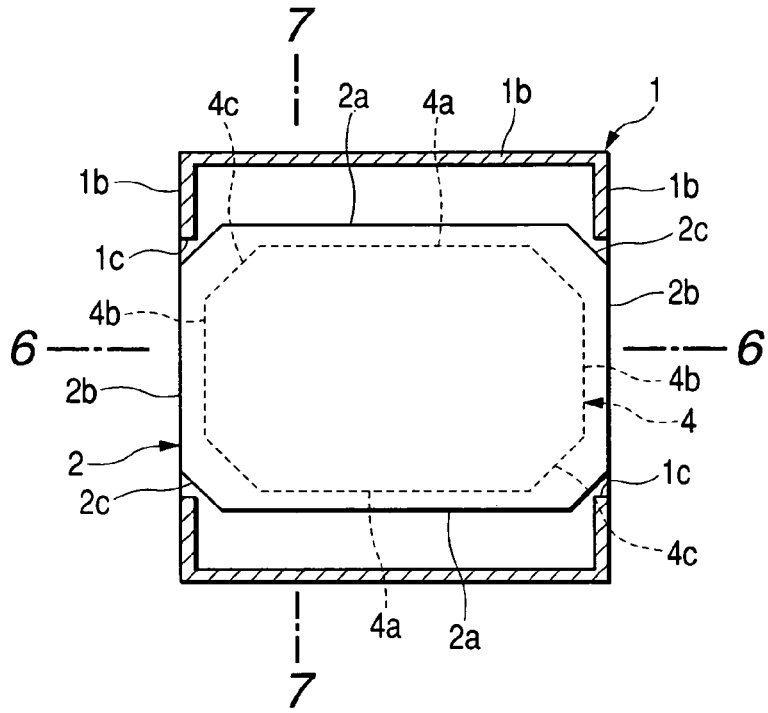
FIG. 4 is a plan view of the nonreciprocal circuit element according to the first embodiment in a state in which a first upper yoke is removed.
Figure 5:
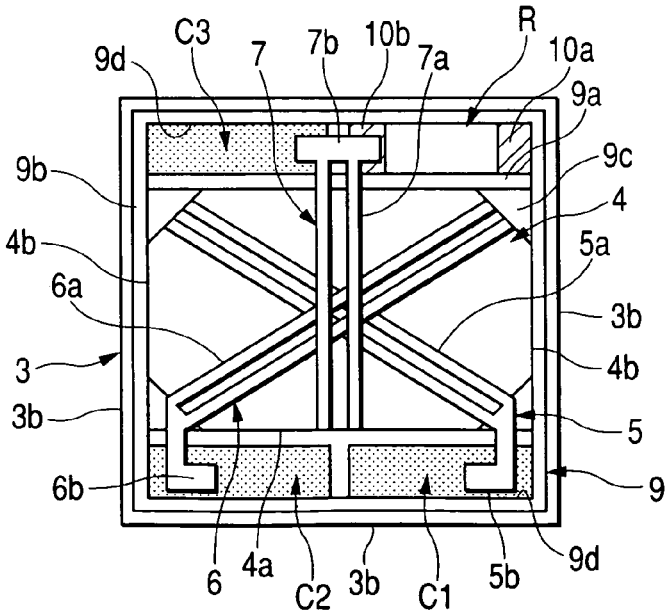
FIG. 5 is a plan view of the nonreciprocal circuit element according to the first embodiment in a state in which a first yoke and a magnet are removed.
Figure 6:
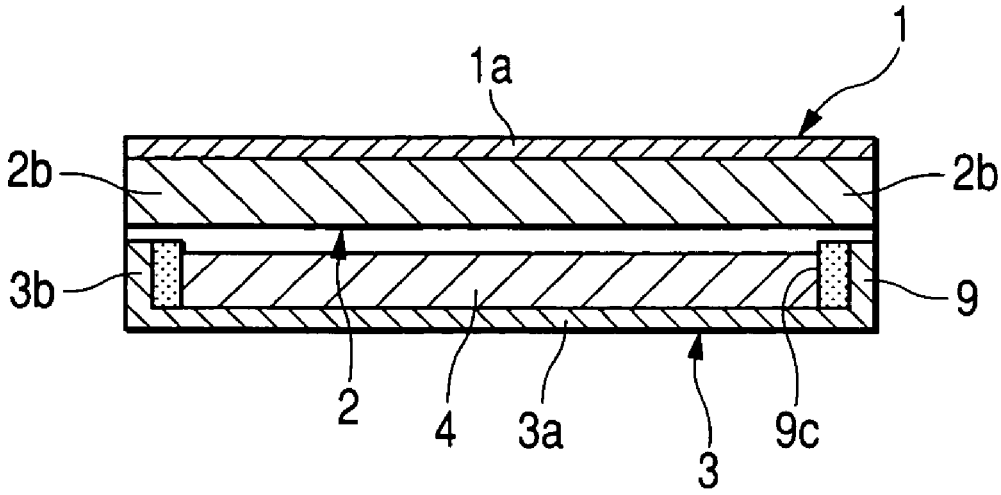
FIG. 6 is a cross-sectional view taken along the line 6—6 of FIG. 4.
Figure 7:
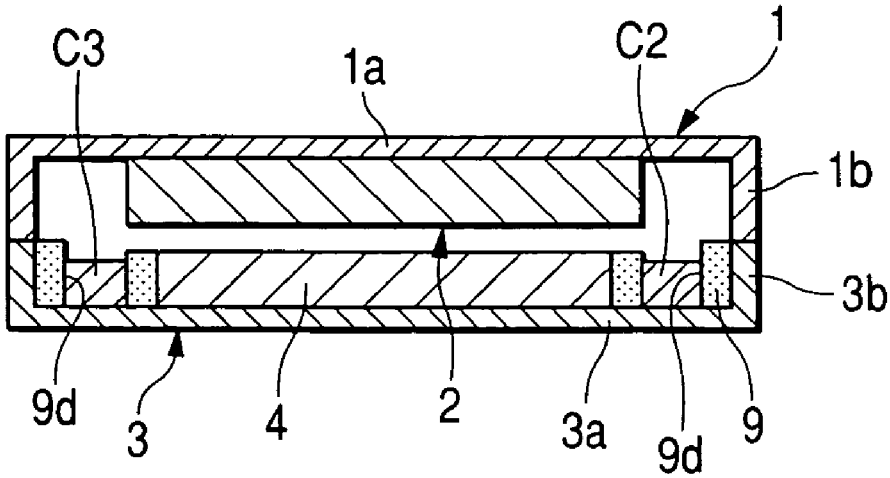
FIG. 7 is a cross-sectional view taken along the line 7—7 of FIG. 4.

Further, FIG. 4 is a plan view of the nonreciprocal circuit element according to the first embodiment in a state in which a first upper yoke is removed, FIG. 5 is a plan view of the nonreciprocal circuit element according to the first embodiment in a state in which a first yoke and a magnet are removed, FIG. 6 is a cross-sectional view taken along the line 6—6 of FIG. 4, and FIG. 7 is a cross-sectional view taken along the line 7—7 of FIG. 4.

Figure 8:
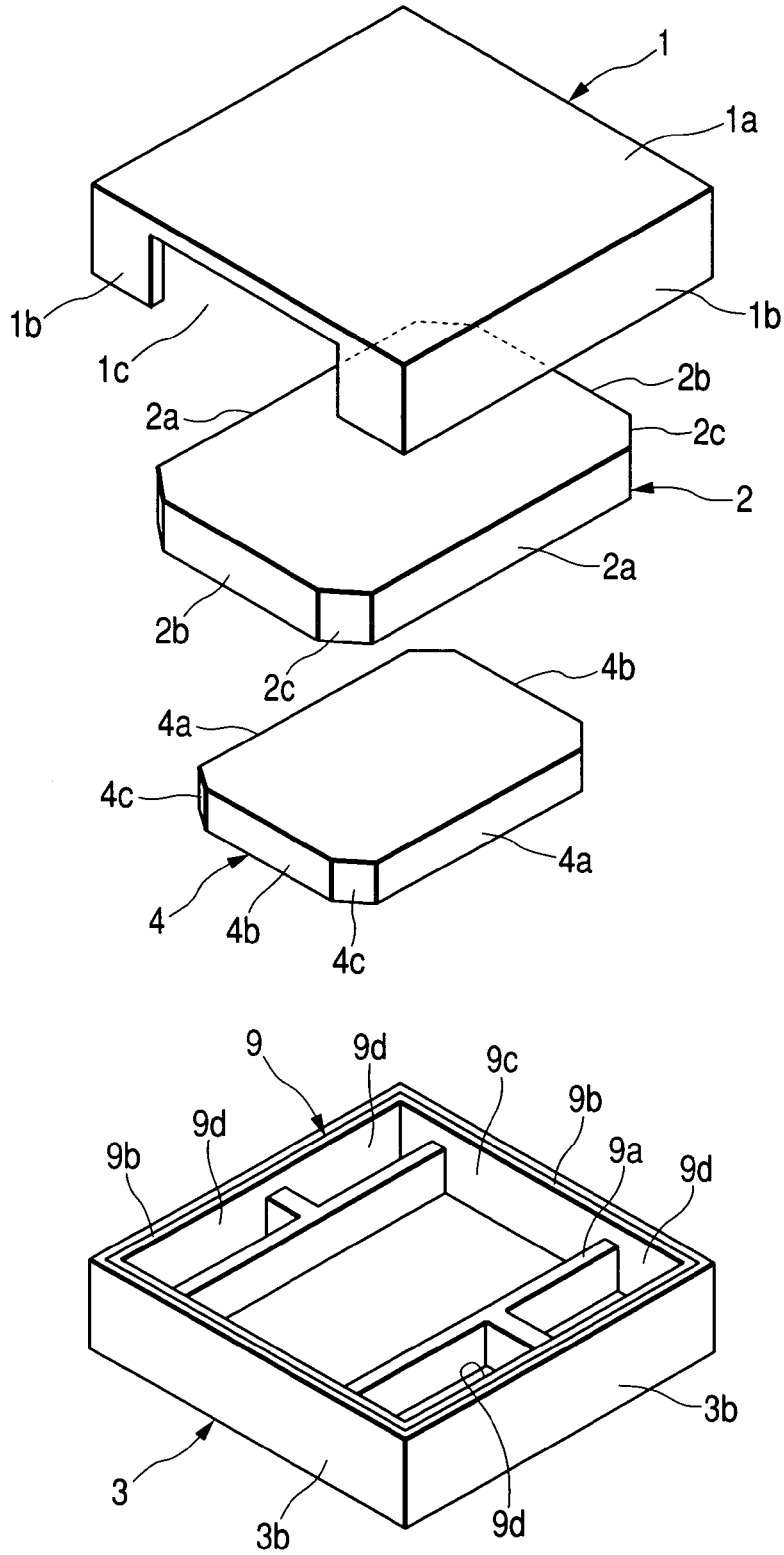
FIG. 8 is an exploded perspective view illustrating main parts of the nonreciprocal circuit element according to the first embodiment.
Figure 9:
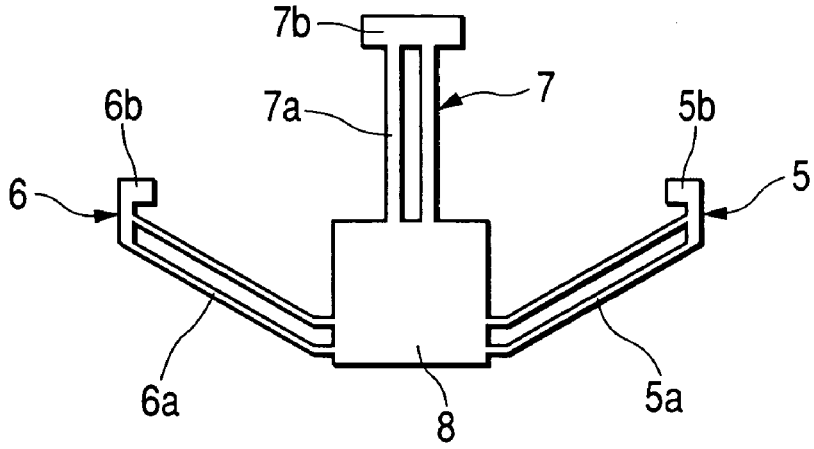
FIG. 9 is a developed view of central conductors incorporated in the nonreciprocal circuit element according to the first embodiment.
Figure 10:
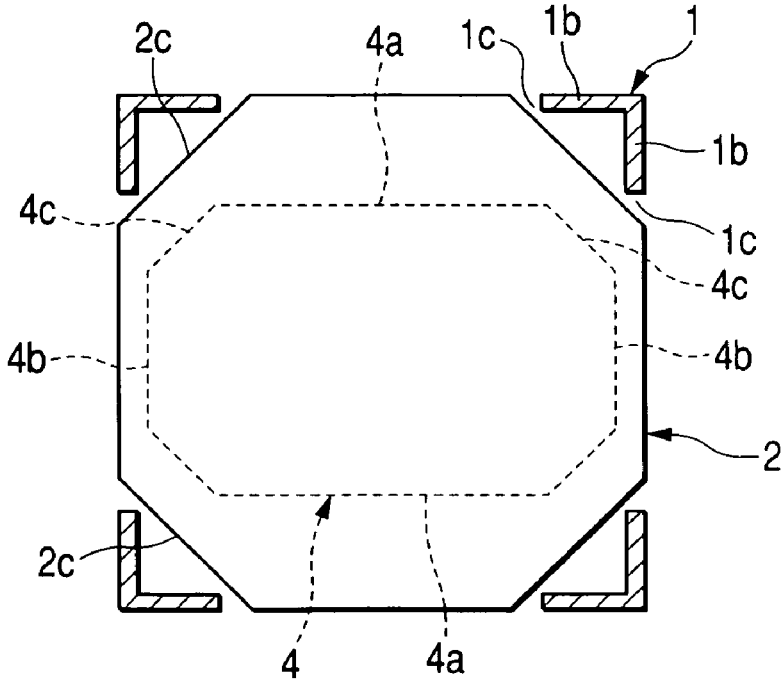
FIG. 10 is a plan view of a nonreciprocal circuit element according to a second embodiment in a state in which an upper plate of a first yoke is removed.
Figure 11:
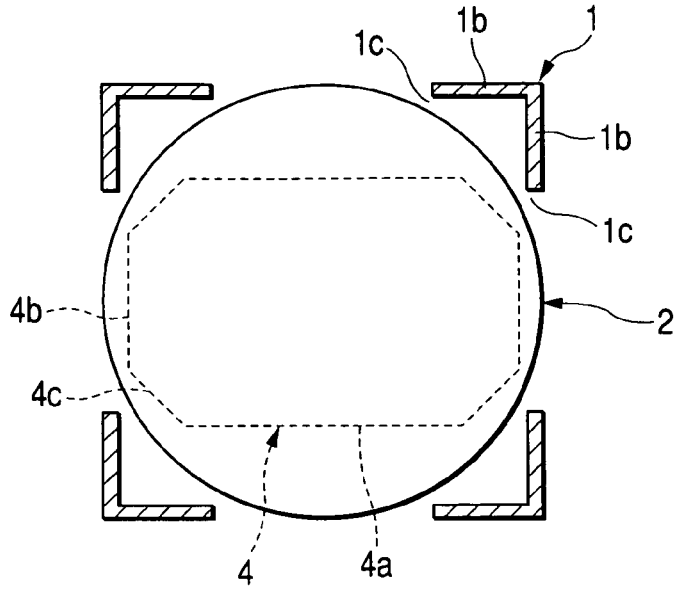
FIG. 11 is a plan view of a nonreciprocal circuit element according to a third embodiment in a state in which an upper plate of a first yoke is removed.
Figure 12:
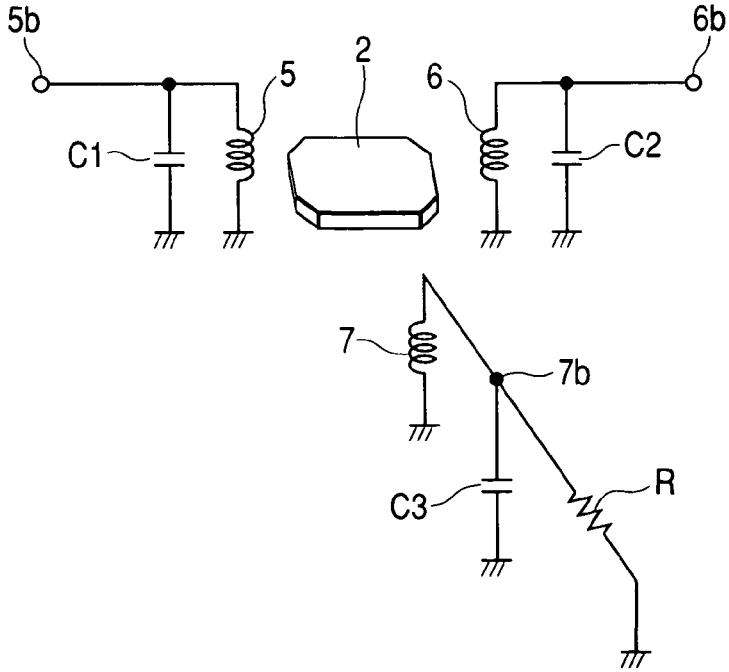
FIG. 12 is an equivalent circuit diagram of the nonreciprocal circuit element according to the present invention.
Figure 13:
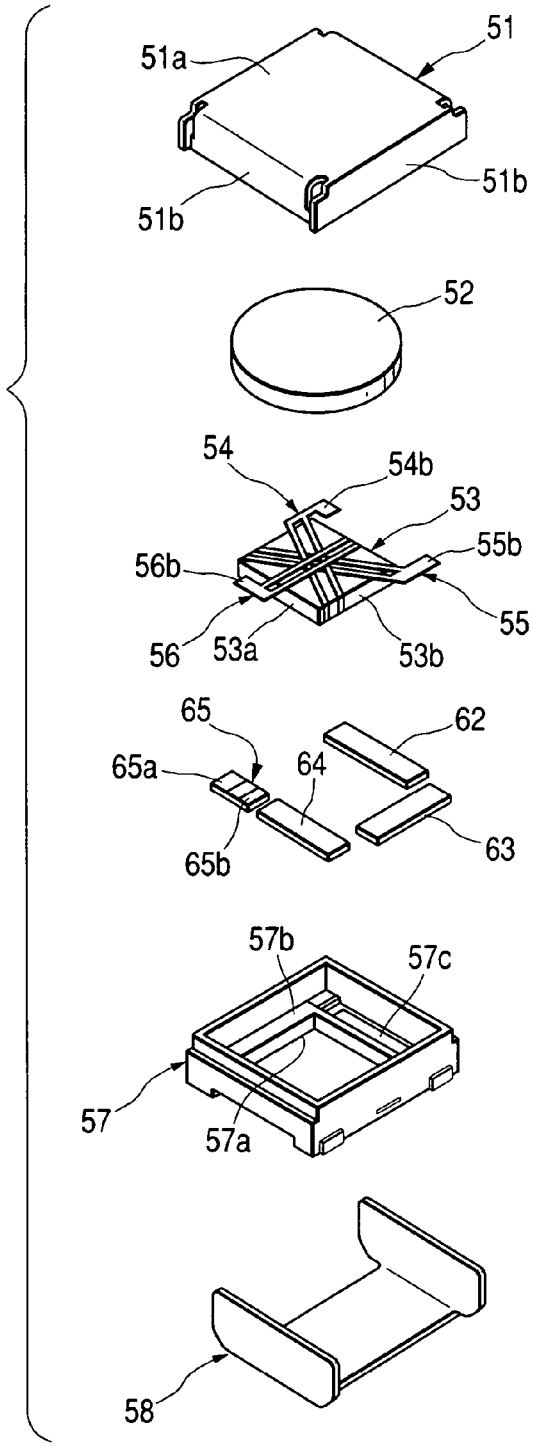
FIG. 13 PRIOR ART
FIG. 13 is an exploded perspective view illustrating main parts of a conventional nonreciprocal circuit element.
Figure 14:
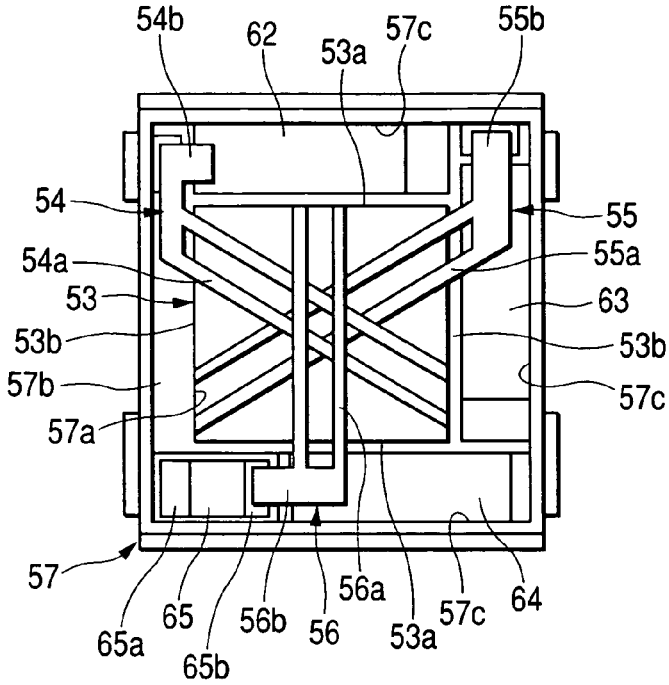
FIG. 14 PRIOR ART
FIG. 14 is a plan view illustrating the main parts of a conventional nonreciprocal circuit element.
Figure 15:
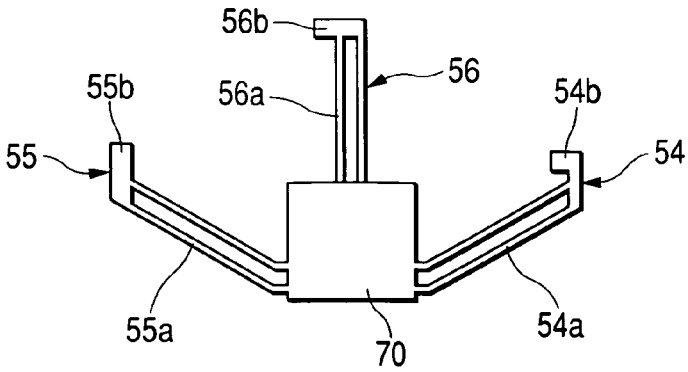
FIG. 15 PRIOR ART
FIG. 15 is a developed view of central conductors incorporated in the conventional nonreciprocal circuit element.

Furthermore, FIG. 8 is an exploded perspective view illustrating main parts of the nonreciprocal circuit element according to the first embodiment, FIG. 9 is a developed view of central conductors incorporated in the nonreciprocal circuit element according to the first embodiment, FIG. 10 is a plan view of a nonreciprocal circuit element according to a second embodiment in a state in which an upper plate of a first yoke is removed; FIG. 11 is a plan view of a nonreciprocal circuit element according to a third embodiment in a state in which an upper plate of a first yoke is removed, and FIG. 12 is an equivalent circuit diagram of the nonreciprocal circuit element according to the present invention.

The configuration of a nonreciprocal circuit element according to a first embodiment of the present invention, in which the nonreciprocal circuit element is employed to an isolator, will now be described with reference to FIGS. 1 to 9. The nonreciprocal circuit element includes a first yoke 1 formed of a box-shaped magnetic plate (an iron plate or the like). The first yoke 1 has a rectangular upper plate 1*a*, side plates 1*b* bent downward from four sides of the upper plate 1*a*, and notch parts 1*c* formed at a central portion between a pair of side plates 1*b* facing each other along a vertical direction.

A rectangular (square) magnet 2 has two long sides 2*a* facing each other, short sides 2*b* extending at right angle relative to the long sides 2*a*, and quadrangular chamfers 2*c* provided at four corners. The magnet 2 is mounted on the first yoke 1 by appropriate means, such as an adhesive or the like, in a state in which ends of the short sides 2*b* placed at both sides are placed in the notch parts 1*c* and the top surface of the magnet 2 contacts the inner surface of the upper plate 1*a*.

A second yoke 3 formed of a magnetic box-shaped plate (an iron plate or the like) has a rectangular bottom plate 3*a*, and four side plates 3*b* bent downward from four sides of the bottom plate 3*a*. In a state in which the bottom plate 3*a* faces the upper plate 1*a*, the second yoke 3 forms a closed magnetic circuit by connecting the side plates 3*b* of the second yoke 3 to the side plates 1*b* of the first yoke 1.

In the illustrative embodiment, an example in which the first and second yokes 1 and 3 have a box-shaped configuration has been described. However, shapes of the first and second yokes 1 and 3 are not limited to this configuration. For example, one of the first and second yokes 1 and 3 may be formed in a box-shaped, and the other may be formed in a U-shaped, so that it is possible to form a closed magnetic circuit by connecting the both side plates 1*b* and 3*b*. Further, both the first and second yokes 1 and 3 may be formed in the U-shaped, so that it is possible to form a closed magnetic circuit by connecting the both side plates 1*b* and 3*b*.

A rectangular (square) and flat ferrite member 4, which is formed of YIG (yttrium iron garnet), has two long sides 4*a* facing each other, two short sides 4*b* facing each other, and chambers 4*c* formed at four corners of the ferrite member 4.

As shown in FIG. 9, first, second and third central conductors 5, 6 and 7 formed of thin conductive plates such as copper or the like are formed by notching metal plates, and extend outward from a centrally disposed, square ground portion 8.

Each of the first, second and third central conductors 5, 6 and 7 has a slit formed lengthwise to be divided into two parts. Also, the first, second and third central conductors 5, 6 and 7 have pairs of conductor parts 5*a*, 6*a*, and 7*a* parallel to one another, and first, second and third port portions 5*b*, 6*b* and 7*b* provided at ends of the conductor parts 5*a*, 6*a* and 7*a*, respectively.

The first, second and third central conductors 5, 6 and 7 are configured such that a ground portion 8 is disposed under the ferrite member 4. In such a state, the conductor parts 5*a*, 6*a* and 7*a* are bent along the side and top surfaces of the ferrite member 4.

In this case, the first, second and third central conductors 5, 6 and 7 are disposed on surfaces different in a vertical direction to be spaced apart from one another by an angle of 120 degrees with a dielectric element (not shown) interposed therebetween, and parts of the first, second and third central conductors 5, 6 and 7 are disposed so as to intersect one another in the vertical direction. In this case, as shown in FIG. 5, the first and second port portions 5*b* and 6*b* are disposed on one of the long sides 4*a* of the ferrite member 4, and the third port portion 7*b* is disposed on the other long side 4*a* of the ferrite member 4.

When the first, second and third central conductors 5, 6 and 7 are mounted on the ferrite member 4, as shown in FIG. 5, the conductor parts 5*a* and 6*a* of the first and second central conductors 5 and 6 are placed at the short sides 4*b* to be arranged so as to traverse the longer face of the ferrite member 4 while the conductor part 7*a* of the third central conductor 7 is placed at the long side 4*a* so as to traverse the shorter face of the ferrite member 4.

At this time, the conductor parts 5*a* and 6*a* of the first and second central conductors 5 and 6 extend the chamfers 4*c* slanting with respect to the ferrite member 4.

A resin case 9, made of a synthetic resin mold, has a bottom wall 9*a*, four side walls 9*b* extending upward from the bottom wall 9*a*, a first receiving portion 9*c* having a rectangular (square) hole formed in the central portion of the bottom wall 9*a*, and second receiving portions 9*d* having holes formed in the bottom wall 9*a* along the length direction of both sides of the first receiving portion 9*c*.

The resin case 9 is integrally formed with the second yoke 3 by molding. Alternatively, the resin case 9 may be combined with the second yoke 3 such that it is separately formed within the second yoke 3.

When the ferrite member 4 having the first, second and third central conductors 5, 6 and 7 mounted thereon is arranged within the first receiving portion 9*c*, a ground portion 8 corresponding to one end of each of the first, second and third central conductors 5, 6 and 7 is connected to the bottom wall 3*a* of the second yoke 3 disposed at the lower portion of the resin case 9, and the second receiving portions 9*d* are arranged along the long sides 4*a* of the ferrite member 4.

When the ferrite member 4 is arranged within the first receiving portion 9*c*, the respective short sides 4*b* of the ferrite member 4 are in proximity to the side plates 3*b* of the second yoke 3 with the sidewalls 9*b* interposed therebetween, so that the ferrite member 4 are elongated between the pair of side plates 3*b*.

First, second and third chip capacitors C1, C2 and C3 and a chip-type resistor R are accommodated in the second receiving portions 9, and lower electrodes (not shown) of the first, second and third capacitors C1, C2 and C3 and an electrode 10*a* at one side of the resistor R are connected to the bottom plate 3*a* of the second yoke 3.

Then, the respective port portions 5*b* and 6*b* of the first and second central conductors 5 and 6 are connected to upper electrodes (not shown) of the first and second capacitors C1 and C2 by soldering, while the third port portion 7*b* of the third central conductor 7 is soldered to an upper electrode (not shown) of the third capacitor C3 and to the top surface of the other-end electrode 10*b* of the resistor R.

In a state in which the magnet 2, the ferrite member 4 and the resin case 9 are interposed in the first and second yokes 1 and 3, the first and second yokes 1 and 3 are combined with each other to form a closed magnetic circuit composed of the first and second yokes 51 and 58, thereby completing the nonreciprocal circuit element.

When the first and second yokes 1 and 3 are combined with each other, the lower surface of the magnet 2 does not contact with the side plates 1*b* and 3*b* while the top surface of the ferrite member 4 is disposed within the dimension of the bottom surface of the magnet 2 in a state in which the long sides of the magnet 2 are joined to the long sides 4*a* of the ferrite member 4 and the short sides 2*b* of the magnet 2 are joined to the short sides 4*b* of the ferrite member 4, respectively.

Consequently, each of the short sides 4*b* of the ferrite member 4 becomes in proximity of extension lines of the side plate 1*b* of the first yoke 1, so that the ferrite member 4 is elongated between the pair of side plates 1*b*.

FIG. 10 shows a nonreciprocal circuit element according to a second embodiment, in which the magnet 2 is rectangular, the chamfers 2*c* are quadrangular, and four ends of the magnet 2 are placed within notch parts 1*c* of the first yoke 1.

The other configuration of the nonreciprocal circuit element is the same as that of the nonreciprocal circuit element shown in the first embodiment. Therefore, the same parts are designated by the same reference numerals, and an explanation thereof will not be given.

FIG. 11 shows a nonreciprocal circuit element according to a second embodiment, in which the magnet 2 is circular, and four ends of the magnet 2, disposed crosswise, are placed within notch parts 1*c* of the first yoke 1.

The other configuration of the nonreciprocal circuit element is the same as that of the nonreciprocal circuit element shown in the first embodiment. Therefore, the same parts are designated by the same reference numerals, and an explanation thereof will not be given.

FIG. 12 is an equivalent circuit diagram of the nonreciprocal circuit element according to the present invention used as an isolator. The first and second grounded capacitors C1 and C2 are connected to one ends of the first and second central conductors 5 and 6. The first and second port portions 5*c* and 6*c* are formed as input and output ports. The third port portion 7*d* to which the third grounded capacitor C3 and the resistor R are connected is disposed at one end of the third central conductor 7.

Also, the other end of each of the first, second and third central conductors 5, 6 and 7 is grounded by the ground portion 8.

In the illustrative embodiment, the example in which the present invention is applied to the isolator has been described. However, that present invention can also be applied to a circulator configured such that the resistor R is not connected to the central conductor.

As described above, the nonreciprocal circuit element according to the present invention comprises a flat ferrite member, first, second and third central conductors disposed on the ferrite member such that they are disposed on surfaces different in a vertical direction with a dielectric element interposed therebetween, and parts thereof intersecting one another in the vertical direction, a magnet disposed on the central conductors, a first yoke disposed so as to cover the top surface of the magnet, and a second yoke forming a closed magnetic circuit in combination with the first yoke, the second yoke being disposed below the ferrite member. The first yoke has a rectangular upper plate, a pair of side plates bent downward from at least sides of the upper plate facing each other, and notch parts formed in the central portion of the pair of side plates. The respective ends of the magnet are placed within the notch parts.

According to the above construction, the magnet can be enlarged and the ferrite member provided corresponding to the magnet can also be enlarged, which increases the lengths of conductor parts of the central conductors mounted on the ferrite member, thereby achieving high performance of the nonreciprocal circuit device without adversely affecting miniaturization.

Since the ends of the ferrite member are disposed in proximity to extension lines of a pair of side plates, the ferrite member can be maximally elongated between the pair of side plates. Accordingly, the lengths of conductor parts of the central conductors mounted on the ferrite member can be increased, thereby acquiring excellent nonreciprocal circuit device.

Also, since the magnet has a quadrangular shape having long sides and short sides and short-side ends of the magnet are placed within the notch parts, the effective area of the magnet can be enlarged, thereby achieving high performance.

Further, since chamfers are formed at corners of the magnet, positioning of the magnet relative to the first yoke is easily made, thereby achieving excellent productivity.

The ferrite member has a quadrangular shape having long sides and short sides. In a state in which the long sides of the magnet are joined to the long sides of the ferrite member and the short sides of the magnet are joined to the short sides of the ferrite member, respectively, the top surface of the ferrite member is disposed within the dimension of the bottom surface of the magnet, and the short sides of the ferrite member are disposed in proximity to the extension lines of the side plates. Thus, the lengths of the central conductors mounted on the ferrite member can be increased, thereby acquiring an excellent nonreciprocal circuit device.

Also, since the chamfers are formed at corners of the ferrite member, conductor parts of the central conductors can be locked thereto to be fastened, thereby securing mounting of the central conductors. Also, since the length of conductor parts of the central conductors mounted on the ferrite member are increased, high performance of the nonreciprocal circuit device can be achieved.

Since the bottom surface of the magnet placed within the notch parts does not contact with the side plates and the second yoke, it is possible to obtain a desirable magnetic bias in the closed magnetic circuit formed between the first and second yokes.

The nonreciprocal circuit element of the present invention comprises a resin case disposed within the second yoke, the resin case having a first receiving portion in which the ferrite member is accommodated, and a plurality of second receiving portions in which a plurality of capacitors connected to the central conductors are accommodated, thereby achieving good assembling performance.

Further, since the first receiving portion is arranged at the central portion of the resin case and the second receiving portions are arranged at both sides of the first receiving portion along the long sides of the magnet and the ferrite member, the lengths of the ferrite member can be maximally increased, which increases the lengths of the central conductors mounted on the ferrite member. Thus, highly efficient, miniaturized devices can be acquired.

What is claimed is:

1. A nonreciprocal circuit element comprising:

a flat ferrite member;

first, second and third central conductors disposed on the ferrite member such that the first, second and third central conductors are disposed on surfaces different in a vertical direction with a dielectric element interposed therebetween, and parts thereof intersecting one another in the vertical direction;

a magnet disposed on the central conductors;

a first yoke disposed so as to cover a top surface of the magnet; and a second yoke forming a closed magnetic circuit in combination with the first yoke, the second yoke being disposed below the ferrite member;

wherein the first yoke has a rectangular upper plate, a pair of side plates bent downward from at least sides of the upper plate facing each other, and notch parts formed in a central portion of the pair of side plates, and respective ends of the magnet are placed within the notch parts.

2. The nonreciprocal circuit element of claim 1, wherein ends of the ferrite member are disposed in proximity to extension lines of the side plates.

3. The nonreciprocal circuit element of claim 1, wherein a bottom surface of the magnet placed within the notch parts does not contact the side plates and the second yoke.

4. The nonreciprocal circuit element of claim 1, wherein a resin case is provided in the second yoke, the resin case having a first receiving portion in which the ferrite member is accommodated, and a plurality of second receiving portions in which a plurality of capacitors connected to the central conductors are accommodated.

5. The nonreciprocal circuit element of claim 1, wherein the first receiving portion is arranged at a central portion of the resin case and the second receiving portions are arranged at both sides of the first receiving portion along long sides of the magnet and the ferrite member.

6. The nonreciprocal circuit element of claim 1, wherein the magnet has a quadrangular shape having long sides and short sides, and ends of the short sides of the magnet are placed within the notch parts.

7. The nonreciprocal circuit element of claim 6, wherein chamfers are formed at corners of the magnet.

8. The nonreciprocal circuit element of claim 6, wherein the ferrite member has a quadrangular shape having long sides and short sides, and in a state in which the long sides of the magnet are joined to the long sides of the ferrite member and the short sides of the magnet are joined to the short sides of the ferrite member, respectively, a top surface of the ferrite member is disposed within the dimension of the bottom surface of the magnet, and the short sides of the ferrite member are disposed in proximity of extension lines of the side plates.

9. The nonreciprocal circuit element of claim 8, wherein chamfers are formed at corners of the ferrite member.

* * * * *